US008922385B2

(12) United States Patent
Brown

(10) Patent No.: US 8,922,385 B2
(45) Date of Patent: Dec. 30, 2014

(54) VEHICLE COUPLING FAULT DETECTING SYSTEM

(71) Applicant: Electro-Motive Diesel, Inc., Chicago, IL (US)

(72) Inventor: Dale Alexander Brown, Lagrange, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 85 days.

(21) Appl. No.: 13/749,936

(22) Filed: Jan. 25, 2013

(65) Prior Publication Data

US 2014/0209756 A1 Jul. 31, 2014

(51) Int. Cl.
*G08B 21/00* (2006.01)
*B61L 15/00* (2006.01)

(52) U.S. Cl.
CPC ..... *B61L 15/0081* (2013.01)
USPC ..... 340/686.1; 340/500; 340/531; 303/7; 246/169 R

(58) Field of Classification Search
USPC ..... 340/686.1, 505, 3.44, 540, 500, 531; 303/3, 7, 15, 20, 123, 128; 701/1, 19, 701/20, 29.1; 246/169 R, 182 A, 182 B
See application file for complete search history.

(56) References Cited

U.S. PATENT DOCUMENTS

| | | | | |
|---|---|---|---|---|
| 4,041,470 | A * | 8/1977 | Slane et al. | 701/29.1 |
| 5,507,457 | A | 4/1996 | Kull | |
| 5,681,015 | A * | 10/1997 | Kull | 246/187 C |
| 5,758,848 | A | 6/1998 | Beule | |
| 6,126,247 | A * | 10/2000 | Paul et al. | 303/7 |
| 6,318,811 | B1 | 11/2001 | Root et al. | |
| 6,824,226 | B2 | 11/2004 | Smith, Jr. et al. | |
| 7,872,591 | B2 | 1/2011 | Kane et al. | |
| 8,583,299 | B2 * | 11/2013 | Goodermuth et al. | 701/19 |

FOREIGN PATENT DOCUMENTS

KR 100538561 12/2005

* cited by examiner

*Primary Examiner* — Anh V La
(74) *Attorney, Agent, or Firm* — Finnegan, Henderson, Farabow, Garrett & Dunner LLP

(57) ABSTRACT

A vehicle coupling fault detecting system is disclosed. The system may include first and second selectively-pressurized fluid conduits containing first and second communication cables that are communicatively coupled when the first and second fluid conduits are connected together. A pressure sensor may detect a pressure within the fluid conduits when the conduits are connected together, and communicate a signal indicative of the pressure through at least one of the first and second communication cables. A controller may receive the signal and determine from the signal whether there is a fault in the connection between the first and second selectively-pressurized fluid conduits.

20 Claims, 4 Drawing Sheets

VEHICLE COUPLING FAULT DETECTING SYSTEM

TECHNICAL FIELD

The present disclosure relates generally to a fault detecting system and, more particularly, to a vehicle coupling fault detecting system.

BACKGROUND

A train consist is a group of rail vehicles that make up a train. In most consists, the group of rail vehicles includes at least one locomotive (often more than one), one or more freight or passenger vehicles, and, in some applications, a caboose. The locomotive(s), although generally located at the leading end of the consist, can alternatively be located at any other position along its length. A locomotive provides power to the rest of the consist, and the lead locomotive generates operator- and/or autonomous control commands directed to components of the locomotive and to other vehicles in the consist (e.g., traction commands, braking commands, destination commands, etc.). The caboose, if present, is generally located at the trailing end of the consist. In some embodiments, control commands can also or alternatively be generated by an End of Train (EOT) unit at the rear of the train and directed to one or more other vehicles in the consist. EOT monitoring systems perform two basic functions. In the first of these functions, the EOT unit monitors brake pipe pressure, motion, and other parameters, and communicates the information via a radio transceiver to a Locomotive Cab Unit (LCU). In a second function, the EOT unit allows an operator to initiate an emergency brake application from the LCU to the EOT unit via the radio link. This provides a means of rapidly exhausting the brake pipe from the rear of the train, supplementing normal emergency braking initiated from the front end of the train.

Communication within a train consist can involve a range of technologies. For example, power between vehicles can be transmitted via hard-wired pinned connections. Control commands such as the commands sent from the LCU to the EOT unit can be facilitated wirelessly using radio transceivers, shortwave radio, and other known technologies. Other ways of communicating power, control commands, and data between vehicles have also been utilized. Although functional, each of the communication technologies described above may have drawbacks. For example, it may be possible for hard-wired pinned connections to be insufficiently coupled or coupled incorrectly, and/or for components of the connections to fail during use (e.g., pins in the connection can break). Wireless communication can be insecure and prone to interference from outside sources. These difficulties increase as a size of the consist increases, while at the same time, the importance of accurate and reliable communication also increases.

One attempt to provide an additional pressure monitoring function for an EOT monitoring system to enable an integrity check of the train is disclosed in U.S. Pat. No. 5,507,457 that issued to Kull on Apr. 16, 1996 ("the '457 patent"). In particular, the '457 patent discloses providing a pressure input capability and software to the LCU microprocessor that allows continuity of the brake pipe of a train to be verified. A pressure sensor is installed in the LCU to sense brake application. A drop in pressure at the EOT unit is expected when a brake application is initiated from the LCU. If a pressure drop is not sensed at the EOT unit within a predetermined period of time, it is assumed to be due to either a corrupted brake pipe or a communications failure between the LCU and EOT unit. The microprocessor in the LCU will then initiate a communications check by interrogating the EOT unit and issuing an alarm if no reply is received.

Although the system of the '457 patent may have provided additional checks on brake pipe integrity for a train, the system may still be problematic. In particular, the system of the '457 patent still relies on wireless communication along the consist, with the inherent difficulties this may present. In addition, the system of the '457 patent only monitors an overall drop in pressure for the entire length of the train between the LCU and the EOT unit. The system does not provide any way of determining where along the train a possible fault may be occurring.

The vehicle coupling fault detecting system of the present disclosure solves one or more of the problems set forth above and/or other problems in the art.

SUMMARY

In one aspect, the present disclosure relates to a coupling fault detecting system. The system may include a first selectively-pressurized fluid conduit, a first communication cable disposed within the first selectively-pressurized fluid conduit and configured to transmit a communication signal, a second selectively-pressurized fluid conduit, and a second communication cable disposed within the second selectively-pressurized fluid conduit and configured to transmit a communication signal. The system may further include a coupling, with the coupling including at least a first connector and a second connector. The first connector may be connected to the first selectively-pressurized fluid conduit, and the second connector may be connected to the second selectively-pressurized fluid conduit. The first and second connectors may be connectable to each other and configured to transmit a communication signal from the first communication cable to the second communication cable when the first and second connectors of the coupling are connected together. A pressure sensor may be configured to detect pressure at the coupling and communicate a signal indicative of the pressure at the coupling through at least one of the first communication cable and the second communication cable. The system may still further include a controller configured to receive the signal and determine from the signal whether there is a fault in the connection between the first and second connectors.

In another aspect, the present disclosure relates to method of detecting a fault in a group of vehicles, wherein the group of vehicles includes at least first and second selectively-pressurized fluid conduits containing first and second communication cables that are communicatively coupled when the first and second selectively-pressurized fluid conduits are connected together. The method may include detecting a pressure within the selectively-pressurized fluid conduits when the conduits are connected together, communicating a signal indicative of the pressure through at least one of the first and second communication cables, receiving the signal at a controller for the group of vehicles, and determining from the signal whether there is a fault in the connection between the first and second selectively-pressurized fluid conduits.

DETAILED DESCRIPTION

Figure 1:
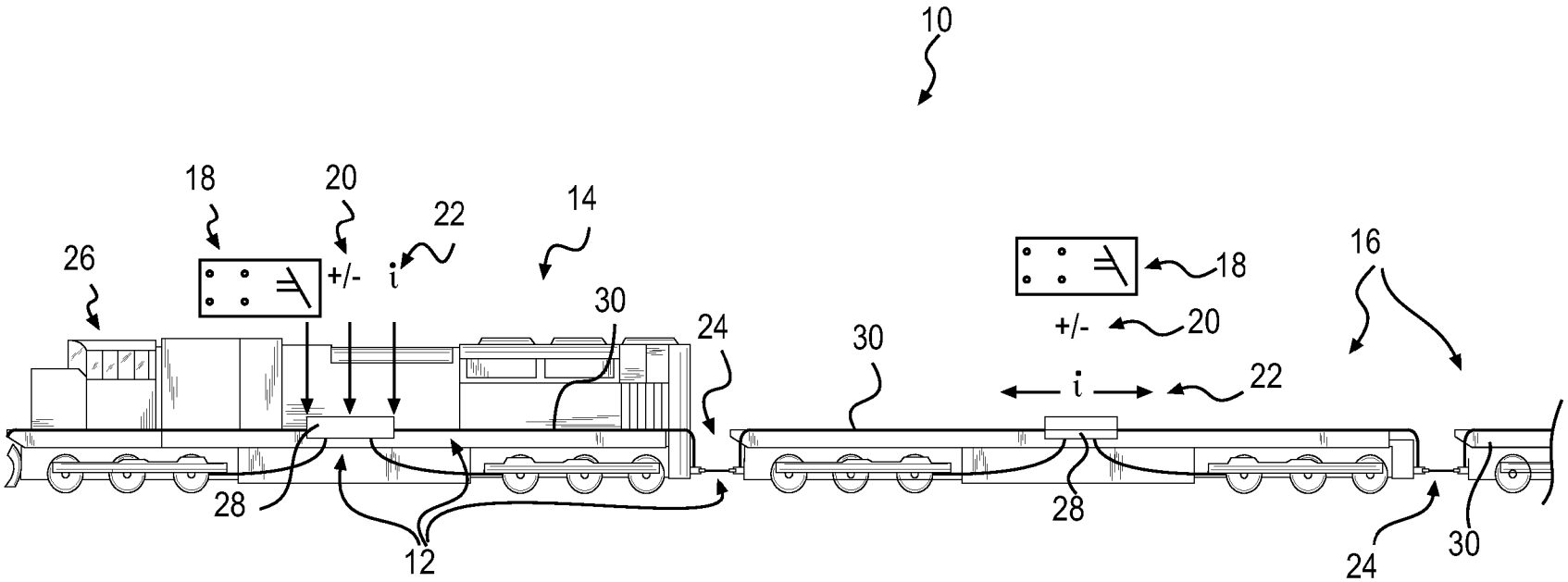
FIG. 1 is a diagrammatic illustration of an exemplary disclosed consist communication system.

FIG. 1 illustrates an exemplary embodiment of a consist 10 having a communication system 12. Consist 10 is depicted and described as being associated with railway transportation and includes a single locomotive 14 and one or more trailing consist vehicles 16. There may be multiple locomotives 14 included in a single consist 10, and locomotives 14 may be placed at various locations along consist 10. Locomotive 14 of FIG. 1 may be the lead vehicle in the depicted consist 10, and a source of controls 18, power 20 (+/−), and data 22 (*i*) for consist 10. Alternatively or additionally, controls 18, power 20, and data 22 of consist 10 may be sourced from trailing consist vehicles 16, if desired. Consist communication system 12 may be utilized to monitor and control locomotive(s) 14 and consist vehicles 16. Consist communication system 12 may include a controller 28 and communication links to the various sensors and actuators along consist 10 that monitor and control operating parameters, diagnostic information, and characteristics for each consist vehicle 16 and for consist 10 as a complete system.

As shown in FIG. 1, the various consist vehicles 16 may share consist vehicle connections 24, of which there may be multiple types. One type of consist vehicle connection 24 may be a mechanical connection between the trucks, the chassis, or the frameworks of consist vehicles 16. Trucks may form the supporting structure for each vehicle, and may include wheels, axles, and braking and suspension systems. Consist vehicles 16 may each include multiple trucks. Consist vehicle connections 24 may be located at the ends of trucks, the vehicle chassis, or other portions of the frameworks for each vehicle, and may connect consist vehicles 16 to each other. Another type of consist vehicle connection 24 may include electronic connections, such that electrical power, control commands, and data signals may be transmitted to and from each consist vehicle 16. Fluid connections may also be made along consist 10, such that pneumatically and hydraulically powered features (e.g., brakes) may extend the length of consist 10. The various consist vehicle connections 24 along consist 10 may be monitored by a consist operator and/or monitored autonomously by consist communication system 12.

Consist 10 may require operator control. An operator may control consist 10 through an interface (not shown) found in an operator station 26 of locomotive 14. The operator interface may include one or more controllable devices that are electronically linked to controller 28. Controller 28 may be configured to control other consist vehicle components based on operator command signals and may be further configured to generate diagnostic signals directed to controllers 28 of other consist vehicles 16. Controller 28 may embody a single microprocessor or multiple microprocessors that include a means for monitoring and controlling operations of consist 10. Numerous commercially available microprocessors can be configured to perform the functions of controller 28. Controller 28 may include all the components required to run an application such as, for example, a memory, a secondary storage device, and a processor, such as a central processing unit, or any other means known in the art for monitoring and controlling consist 10.

Various operating parameters and characteristics of consist 10, consist vehicles 16, and consist vehicle connections 24 may be detected and monitored using strategically placed sensors at various locations along consist 10. Changes in physical phenomena such as, but not limited to, pressure, light, liquid level, fluid flow, proximity, temperature, angular speed, and displacement may produce changes in the voltages, currents, resistances, capacitances, or inductances of the sensors. These changes in the voltages, currents, resistances, capacitances, or inductances at the sensors may be conditioned, amplified and routed to controller 28 via consist communication system 12. Controller 28 may then utilize stored algorithms, equations, subroutines, look-up maps and/or tables to analyze the operational condition data of consist 10, and may exercise autonomous pre-configured control over various elements of consist 10 and/or may provide data to the operator interface for operator assessment and control.

Various known circuits may be associated with controller 28, including power supply circuitry, signal-conditioning circuitry, solenoid driver circuitry, communication circuitry, and other appropriate circuitry. Controller 28 may receive signals from and send signals to both the operator interface and various components of the consist including other controllers 28 in consist 10. In such an arrangement, consist communication system 12 may enable all controllers 28, and components associated with controller 28, to operate in tandem; controlling various operations, e.g., braking and, traction-type operations.

Whether or not every consist vehicle 16 has a controller 28, or means to generate and/or analyze data or run diagnostics, each consist vehicle 16 may be able to receive and transmit power as well as data and control signals through consist communication system 12. Consist communication system 12 may include a plurality of cables for this purpose. The cables may include a power transmission cable, a control cable and a data cable. The cables may further include a redundant power transmission cable, a redundant control cable and a redundant data cable, if desired. The data cables may be twisted pair or coaxial cables made of copper or fiber optics. Electro-magnetic cables may also be used to transmit power, control and/or data signals. The power, data and control cabling of consist communication system 12, along with any redundant sets of the same, may be housed and protected within a fluid conduit 30. The cables provided through fluid conduits 30 may be capable of reliably transmitting high bandwidth signals that allow for timely communication of information over consist communication system 12 for monitoring the real-time status of various components along the entire length of consist 10.

Some or all of fluid conduits 30 may be filled with compressed air or another inert gas. The air may be compressed at a pressure source located at, for example, locomotive 14 or another location along consist 10. The compressed air in fluid conduit 30 may help prevent ingress of debris and water. In alternative implementations, fluid conduit 30 may be filled with oil or other non-gas fluid, which may be used to hydraulically affect mechanical motion at brakes or other areas of consist 10. The flow in fluid conduit 30 may be relatively stagnant under normal operating conditions. Fluid conduit 30 may be a contiguous conduit extending the distance of consist 10 via connections 24 in-between consist vehicles 16.

Figure 2:
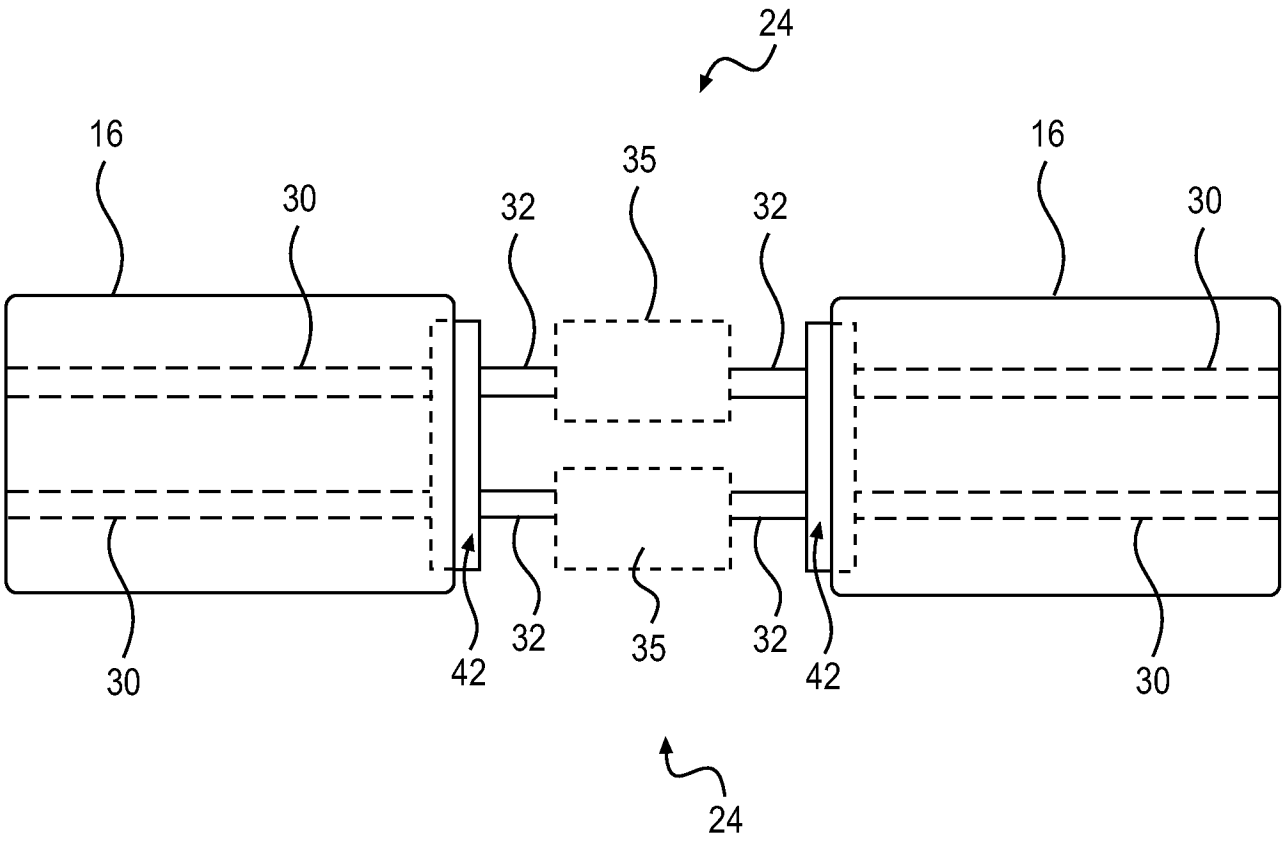
FIG. 2 is a diagrammatic illustration of an exemplary vehicle coupling system used with the consist communication system of FIG. 1.
Figure 3:
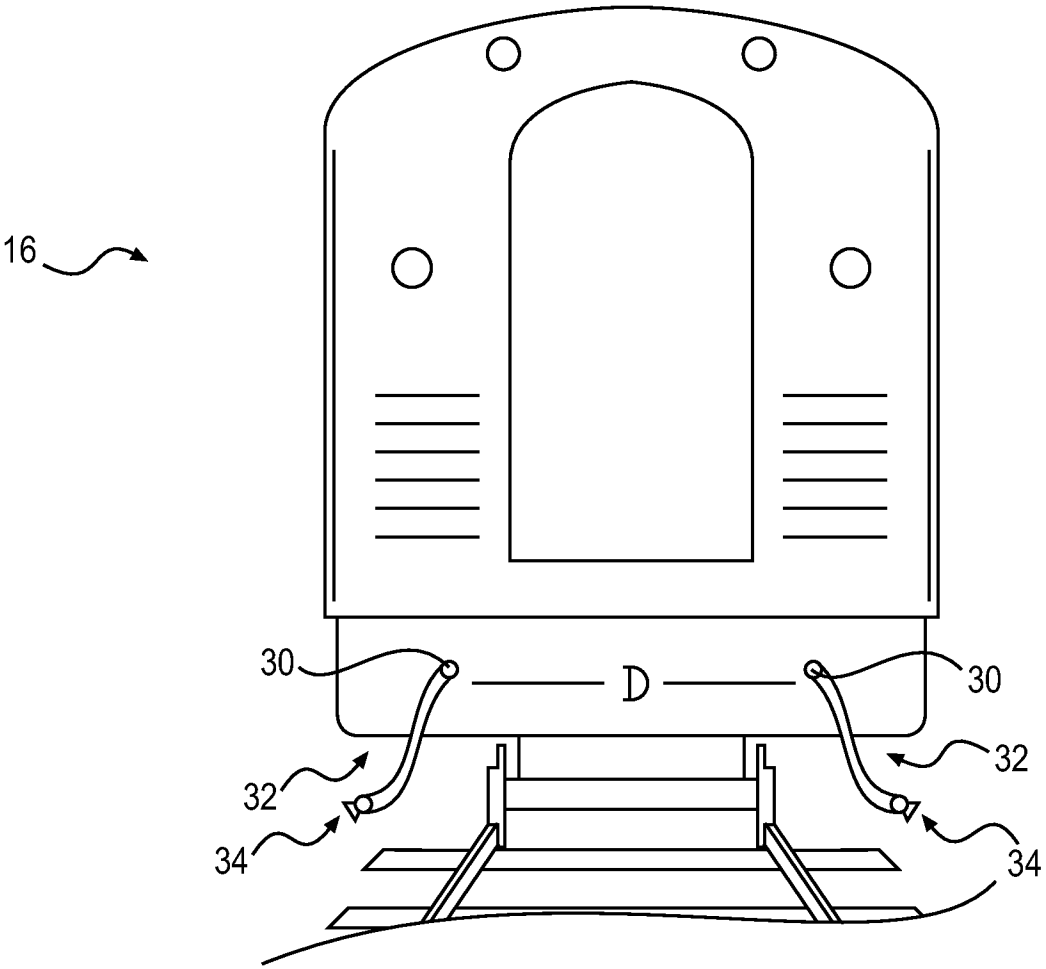
FIG. 3 is a pictorial illustration of a portion of the exemplary disclosed vehicle coupling system of FIG. 2.
Figure 4:
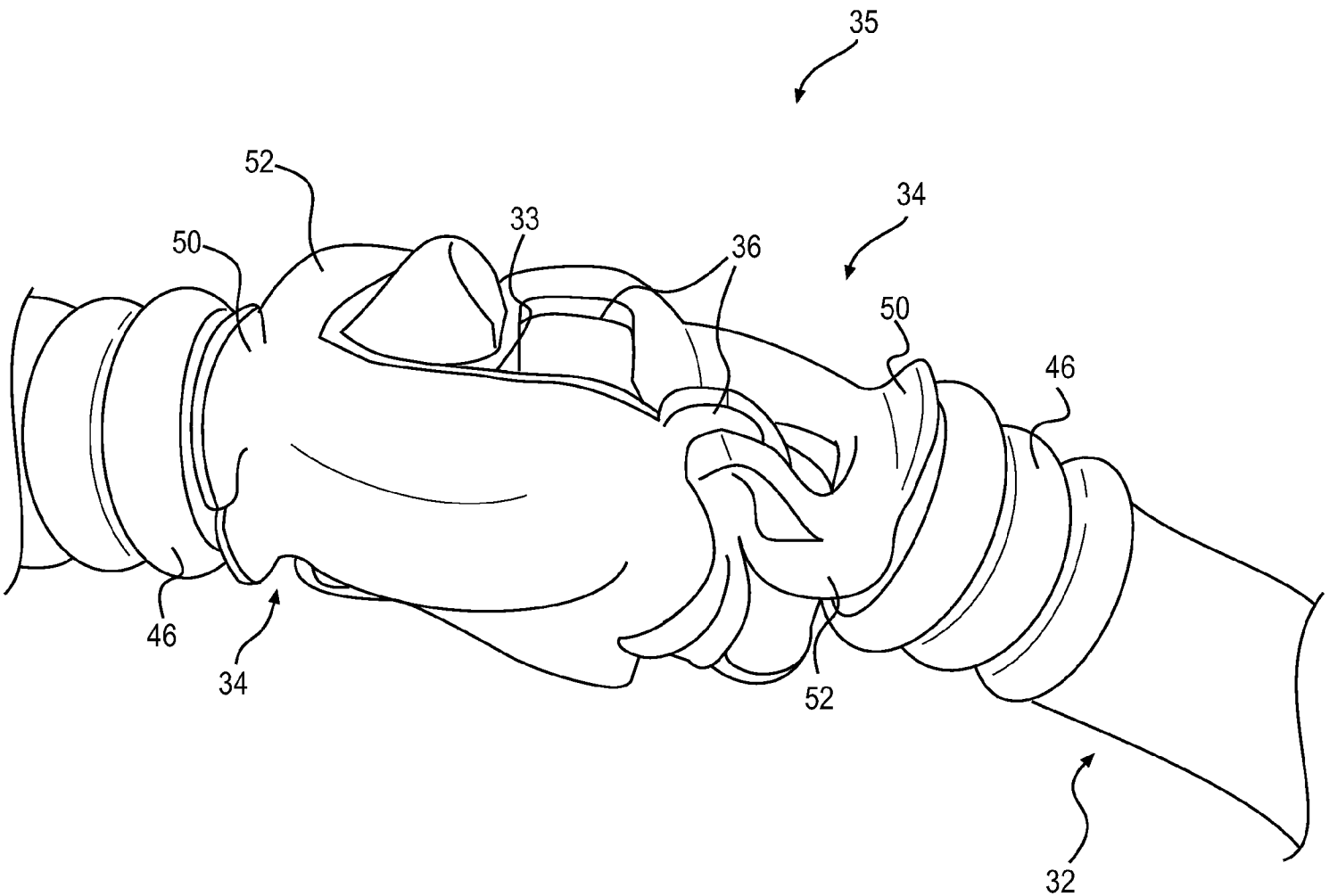
FIG. 4 is a pictorial illustration of an exemplary disclosed vehicle coupler that may be used with the consist communication system of FIG. 1.

FIGS. 2 and 3 provide more detail of a possible implementation for consist vehicle connections 24 in-between consist vehicles 16. One or more fluid conduits 30 on each vehicle 16 may provide communication passageways for one or more of pressurized fluid, data links, control information, and power cables connected between consist vehicles 16. Two or more fluid conduits 30 may extend along the length of each vehicle 16. The portions of fluid conduits 30 extending along the length of each vehicle 16 may be one or more interconnected sections of pipe secured to the underside of each vehicle 16. The length of fluid conduit 30 on each vehicle 16 may be connected at each end to one end of an angle cock (not shown), which can be closed to prevent fluid from flowing along conduit 30. Each angle cock may be connected at an opposite end to one end of a flexible hose 32, with the opposite end of flexible hose 32 connected to a coupling 35. One possible implementation for coupling 35 may be a glad-hand coupling, as is well known in the art. Glad-hand coupling 35 is one example of a time-proven and reliable coupling used to connect fluid conduits 30 extending along each vehicle 16. As shown in FIG. 4, glad-hand coupling 35 is made up of two glad-hand connectors 34. Glad-hand connectors 34 may each have a pair of retaining tabs 36 surrounding a generally flat engaging face 33. Faces 33 of paired glad-hand connectors 34 may be placed together, and one or both of the glad-hand connectors 34 may be rotated such that retaining tabs 36 engage each other in a snap-lock position. Glad-hand coupling 35 may provide a secure connection, while allowing for a clean break-away of glad-hand connectors 34, (i.e., without damaging glad-hand connectors 34), if consist vehicles 16 are separated without first uncoupling glad-hand connectors 34. Glad-hand connectors 34 may be equipped with seals (not shown), which engage face 33, and may help prevent fluid from escaping fluid conduit 30. Additionally, seals may inhibit the ingress of water or debris into fluid conduit 30. When glad-hand connectors 34 and glad-hand coupling 35 are referred to throughout this disclosure, one of ordinary skill in the art will recognize that any number of different couplings and/or connectors of similar or different configurations may be used without departing from the scope of the disclosure.

As shown in FIGS. 2 and 3, fluid conduits 30 on each consist vehicle 16 may be connected with similar fluid conduits 30 associated with an adjacent consist vehicle 16. In one implementation, one fluid conduit 30 on each consist vehicle 16 may serve as the pneumatic line, air hose, or brake pipe for the consist air brake system, while the other fluid conduit 30 may serve as a communication conduit for consist communication system 12. For example, fluid conduit 30 located on the starboard side of consist vehicle 16 may serve as the air hose, and conduit 30 located on the port side may serve as the communication conduit. Yard hostlers, who prepare train consists for travel, may connect fluid conduits 30 of one consist vehicle 16 with corresponding fluid conduits 30 on the adjacent consist vehicle 16. These connections can be made by engaging the two glad-hand connectors 34 at the end of each flexible hose 32 connected to each fluid conduit 30 on adjacent vehicles 16. Starboard and port side fluid conduits 30 may be separated from each other on consist vehicle 16 by a distance D greater than the combined length of connected or paired flexible hoses 32. Given the length of distance D separating the starboard and port side fluid conduits 30, it may be difficult (if not impossible) for the yard hostlers to make inappropriate connections of fluid conduits 30. Connections of fluid conduit 30 may be made with a wide variety of couplers and connectors found in the industry. Fluid conduits 30 and flexible hoses 32 on each consist vehicle 16 may be separate components having different structures and characteristics, all one contiguous component of the same structure, or separate components that are integrally connected through various means.

As shown in FIG. 2, pressure sensors 42 may be provided in proximity to the ends of fluid conduits 30 and flexible hoses 32. Pressure sensors 42 may be configured to detect fluid pressure on an upstream side and/or a downstream side of one or more glad-hand couplings 35. One possible implementation may include separate pressure sensors that produce signals indicative of the fluid pressure in each of two fluid conduits 30 on a consist vehicle 16. Alternatively, a pressure sensor may be configured to produce signals indicative of a pressure difference between two fluid conduits. One of the two fluid conduits 30 may serve as an air hose that provides pneumatic pressure for brakes, and the other of the two fluid conduits 30 may serve as a selectively pressurized communication conduit for housing cables that may include one or more of a power transmission cable, a control cable, and a data cable. Pressure sensors 42 may be placed in the vicinity of the connections between the fluid conduits 30 and the flexible hoses 32 that connect to glad-hand coupling 35. Various implementations may include placement of pressure taps or plenums at or near the ends of each fluid conduit 30 on each consist vehicle 16, somewhere along the lengths of flexible hoses 32, or directly on each of the glad-hand connectors 34 that make up glad-hand coupling 35.

Pressure sensors 42 may be configured to detect absolute pressure at a particular location, or relative pressure, which may be indicative of a fluid flow. In one exemplary implementation, pressure sensors 42 may be configured to detect the pressure difference between a conduit 30 that forms part of an air brake system and a conduit 30 that forms part of a communication system. As shown in FIG. 2, pressure sensors 42 may detect any potential pressure difference between these two conduits at the same end of a consist vehicle 16 in consist 10. Placement of pressure sensors 42 on an upstream side and a downstream side of one or more couplings 35, as shown in FIG. 2, may further enable detection of pressure differences across couplings 35, or changes in pressure relative to steady state pressures in fluid conduits 30. Pressure sensors 42 may be configured to detect a real-time pressure difference between consist vehicles 16 that may be indicative of a coupler fault, or other circumstances indicative of a pressure loss in one or more fluid conduits 30 on a consist vehicle relative to other portions of an air brake system or a selectively pressurized communication system on consist 10. Although FIG. 2 illustrates two fluid conduits 30 on each consist vehicle 16, there may be a smaller or greater number of fluid conduits on each consist vehicle 16, and pressure sensors 42 may be configured to detect absolute pressure at select ones of fluid conduits 30, or differential pressure across select ones of fluid conduits 30.

Pressure sensors 42 may be further configured to communicate signals directly through data cables within a fluid conduit 30, where the fluid conduit 30 is acting as a communication conduit as part of consist communication system 12. Signals produced by pressure sensors 42 may be indicative of pressures or pressure differences detected at a particular vehicle 16. These pressure signals may also include vehicle identification information, location information, or other data indicative of which coupling is upstream or downstream of the pressure sensor producing the signal. Controller 28 may be configured to receive these signals from pressure sensors 42 and determine whether conditions at a particular coupling 35, or at a particular consist vehicle 16 are indicative of a potential fault.

As one non-limiting example, if a normal condition calls for a nominal steady state fluid pressure within a fluid conduit 30, controller 28 may be configured to determine that a coupler fault condition, or other component fault condition may exist if a pressure difference is detected across the coupling 35 or between fluid conduits 30. In determining whether a potential fault exists, controller 28 may be configured to compare the pressure difference to a threshold, where the threshold may be provided as input by an operator, retrieved from a look-up table or other database, or determined from an algorithm as a function of other operating parameters.

Alternatively, controller 28 may be configured to determine that a coupler fault condition may exist if a pressure difference is detected between one fluid conduit acting as an air hose for an air brake system at a particular location and another fluid conduit acting as a communication conduit at that location. Controller 28 may also be further configured to compare a detected pressure difference to a threshold in this alternative implementation.

In yet another alternative implementation, controller 28 may be configured to determine that a coupler fault condition may exist if a change in pressure as a function of time exceeds a threshold. For example, if an expected steady state pressure within a conduit 30 is approximately 90 psi, controller 28 may be configured to indicate a potential coupler fault if a detected change in pressure at the location of that coupler over a designated time period exceeds an upper threshold that may fall approximately within the range from 20-30 psi over the designated time period. Changes in pressure may be measured across a coupling 35 from signals received from pressure sensors 42 on opposite sides of the coupling. Alternatively, changes in pressure may be measured between a pressure in a fluid conduit 30 acting as an air hose for an air brake system at a particular location on a vehicle 16 and another fluid conduit 30 acting as a communication conduit at that same location.

In addition to preventing the ingress of water and debris and the loss of pressure in fluid conduit 30, it may also be important to safeguard components of consist communication system 12 housed within each fluid conduit 30 from environmental conditions. Flexible hoses 32 connected to the ends of each fluid conduit 30 may include multiple and various layers of material (not shown). For example, each flexible hose 32 may include an inner tube, a fabric reinforcement, and an outer cover. The inner tube may be made from a synthetic elastomer that is configured to come in contact with fluid, filler, cabling and other elements that constitute consist communication system 12. A fabric reinforcement may overlay the inner tube and include, for example, a multi-ply, polyester material. Each flexible hose 32 may further have a steel wire braid reinforcement (not shown) in conjunction with fabric reinforcement, if desired. In various implementations, an oil, weather and abrasion resistant outer cover made from a synthetic elastomer may encase the aforementioned two layers. The range of operating temperatures of flexible hoses 32 may be about −55° F. to +176° F. (−50° C. to +80° C.). The diameter of flexible hoses 32 may range between about 2.063 and 2.125 inches for the outer diameter and between about 1.375 and 1.434 inches for the interior diameter. The maximum operating pressure of each flexible hose 32 and fluid conduit 30 may be about 140 psi. The minimum burst pressure may be about 1000 psi. The minimum pull-off force may be about 2,900 lbs. The minimum bend radius of each flexible hose 32 may be about 9.0 inches. Flexible hoses 32 and fluid conduits 30 may be rugged, and consequentially, long-term means of housing and protecting consist communication system 12.

As shown in FIG. 4, glad-hand connectors 34 may include retaining tabs 36 that may protrude away from flanges 50 and that may be configured to retain interlocking fittings 52 of each adjoining glad-hand connector 34 upon coupling. A retention member 46 may be attached to each flange 50 and configured to engage an outer cover of the associated flexible hose 32 to provide an opportunity to tighten or loosen the attachment of glad-hand connector 34 with flexible hose 32 and fluid conduit 30. In addition to providing a pressurized contiguous conduit generally free of debris and water, glad-hand connector 34 may bring data, control and power cables from adjoining flexible hoses 32 and fluid conduits 30 into alignment with each other.

In various implementations, data or signals such as the signals produced by pressure sensors 42 may be generated, processed, or converted into an optical signal that may be transmitted through a plurality of fiber optic cables (not shown) held in a fixed alignment within glad-hand connector 34. A cover may be provided on each glad-hand connector 34 to isolate and seal the fiber optic cables from the external environment when glad-hand connector 34 is uncoupled. Pressure data from pressure sensors 42 may be transmitted from one glad-hand connector 34 to another adjoining glad-hand connector 34 via a lens or other optical component at the end of each fiber optic cable. In further alternative implementations, flexible hoses 32 and fluid conduits 30 may house non-contact electro-magnetic cables (not shown). These cables may also be used to transmit data, control commands, and/or electrical power. Pressure data from pressure sensors 42 may be transmitted from one glad-hand connector 34 to another adjoining glad-hand connector 34 via inductance at one or more transformer coils provided at the ends of each electro-magnetic cable. To reduce eddy-current losses, these transformer coils may be wound on a common core that consists of laminated iron. The transformer coils may step up or step down the voltage from one glad-hand connector 34 to another. Additional techniques may be employed to reduce inductive interference that one coil may experience on account of another adjoining coil. Power and data cables passing through flexible hoses 32 and fluid conduits 30 may function at different frequencies as an additional measure to reduce inductive interference.

Operation of the disclosed vehicle coupling fault detecting system will be described in the following section in order to further illustrate the disclosed concepts.

INDUSTRIAL APPLICABILITY

The disclosed vehicle coupling fault detecting system may be used with any rail or non-rail transportation system to provide a reliable, accurate, durable, and secure means of determining whether there are faults in the system, and where those potential faults are located. The presently disclosed consist communication system 12 may be utilized with any number of vehicles and/or different types of vehicles in various arrangements. For example, consist 10 could include additional locomotives, passenger cars, freight cars, tanker cars, etc. Additionally, consist 10 may apply to non-rail transportation systems, e.g., commercial delivery trucks, recreational vehicles, tractors/trailers and other modes of transportation and freight delivery, as desired. By placing pressure sensors upstream and downstream of each coupling along fluid conduits 30 and flexible hoses 32 that make up part of consist communication system 12 and/or an air brake system, the disclosed system provides a simple, reliable, and effective means for monitoring whether there are any coupler faults, or other potential faults signaled by changes in pressure at various points along consist 10, and exactly where such faults may be located.

The longer the consist, the more important it may be that data, control commands, and power are effectively relayed and maintained along the length of the linked consist. The disclosed consist communication system may provide a rugged and low-maintenance means for delivering signals such as the signals produced by pressure sensors 42, and protecting consist communication system 12 along consist 10 through use of proven components. The disclosed consist communication system may have reduced ingress of debris and water into fluid line connectors, when the connectors are uncoupled, by covering the ends of the fluid conduit during uncoupling.

While preparing a consist for operation, yard hostlers may connect multiple and various fluid conduits 30 along consist 10 by joining glad-hand connectors 34 at the ends of flexible hoses 32 at consist vehicle connections 24. Hostlers may connect fluid conduits 30 and flexible hoses 32 associated with consist communication system 12 with corresponding fluid conduits 30 and flexible hoses 32. In similar fashion, hostlers may connect pairs of fluid conduits 30 associated with pneumatically or hydraulically controlled systems. As the various fluid conduits 30 and flexible hoses 32 associated with consist 10 may appear to be identical and present a risk of being mismatched, they may be positioned on consist 10 in such a way that they are separated from each other by a distance D that exceeds the combined length of mismatched fluid conduits and flexible hoses. For example, distance D may be such that a fluid conduit 30 and flexible hose 32 associated with consist communication system 12 may not be able to be inadvertently coupled with a fluid conduit 30 and flexible hose 32 associated with the air brake system. Hostlers may make the connections by engaging couplers 35. Upon coupler engagement, covers (not shown) within glad-hand connectors 34 may open, and power, data and control cables may be aligned in such a way so as to establish communication paths.

Operation of consist 10 may be monitored and/or controlled through consist communication system 12 autonomously by controller 28 and/or manually by an operator via an operator interface (not shown) found in operator station 26. During operation of consist 10, controller 28 may digitally communicate and coordinate with other controllers 28 and other components of consist 10. Pressure sensors 42 located along consist 10 on each side of couplings 35 may alert controller 28 and/or the consist operator of potential coupler faults at any point along consist 10. Data communication along consist 10 may be accomplished via fiber optic cables, electro-magnetic cables, or other signal-carrying medium contained within fluid conduits 30 and flexible hoses 32. The cables contained within fluid conduits 30 and flexible hoses 32 may enable reliable transmission of high bandwidth data from pressure sensors 42 and any number of other sensors or monitoring devices along consist 10 to controller 28 without danger of interference or loss of signal as may occur when relying on wireless transmissions. Pressure sensors 42 may also provide data that is available in real time to monitor changing conditions at each consist vehicle along the consist, as well as data that may be stored by controller 28 to establish a record of conditions along consist 10 such as air pressure in brake lines or in communication conduits at each of the consist vehicles. Changes in pressure or absolute pressure within fluid conduits 30 along consist 10, pressure differentials between fluid conduits 30 that are serving different purposes such as air hoses and communication conduits, and pressure differentials across couplings 35 between consist vehicles 16 allow an operator to pinpoint any potential problems and take actions to resolve the potential problems.

Fluid conduit 30 and flexible hose 32 may be similar to other fluid conduits and flexible hoses common in the industry in their constitution and installation. One or ordinary skill in the art will also recognize that a fluid conduit 30 and one or more flexible hoses 32 on each consist vehicle 16 may be separate components having different structures and characteristics, all one contiguous component of the same structure, or separate components that are integrally connected through various means. Consequently, the installation and maintenance of fluid conduit 30 may not require unique and/or additional instrumentation, training or skill. Additionally, as fluid conduit 30 and flexible hose 32 may be similar in constitution and installation to other fluid conduits and hoses in the industry, they may therefore be durable apparatus designed to withstand the harsh operating conditions and potentially inclement environments that are common to consist 10.

Glad-hand connectors 34 may likewise be common in the industry and may similarly provide a reliable, familiar and durable means for connecting fluid conduits 30 and flexible hoses 32 along consist 10. Glad-hand connectors 34 may be designed in such a way so as to align the data, control and power cables, therein disposed, with those disposed within an adjoining glad-hand connector 34 during glad-hand coupling. Glad-hand connectors 34 are designed to withstand frequent engagement and disengagement. Flexible hoses 32 and fluid conduits 30 may be pressurized so as to prevent the ingress of water and/or debris during consist 10 travel and engagement and disengagement of couplers 34.

Given their durable constitution, common-to-the-industry installation and maintenance, and means of protecting against external hazards, fluid conduits 30, flexible hoses 32, and glad-hand connectors 34 may comprise a cost-effective and long-lasting means of routing, facilitating and protecting consist communication system 12 for a number of consist-related situations. One of ordinary skill in the art will recognize that the exact structure and characteristics of these various elements may be changed in accordance with industry standards or procedures in order to provide the benefits of uniformity and common installation and maintenance procedures, or may also be varied in order to conform to special requirements or parameters.

It will be apparent to those skilled in the art that various modifications and variations can be made to the disclosed vehicle coupling fault detecting system without departing from the scope of the disclosure. Other embodiments of the vehicle coupling fault detecting system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A coupling fault detecting system, comprising:

a first selectively-pressurized fluid conduit;

a first communication cable disposed within the first selectively-pressurized fluid conduit and configured to transmit a communication signal;

a second selectively-pressurized fluid conduit;

a second communication cable disposed within the second selectively-pressurized fluid conduit and configured to transmit a communication signal;

a coupling, the coupling including at least a first connector and a second connector, wherein:

the first connector is connected to the first selectively-pressurized fluid conduit;

the second connector is connected to the second selectively-pressurized fluid conduit; and the first and second connectors are connectable to each other and are configured to transmit a communication signal from the first communication cable to the second communication cable when the first and second connectors of the coupling are connected together; and a pressure sensor configured to detect pressure at the coupling and configured to communicate a signal indicative of the pressure at the coupling through at least one of the first communication cable and the second communication cable; and a controller configured to receive the signal and determine from the signal whether there is a fault in the connection between the first and second connectors.

2. The coupling fault detecting system of claim 1, wherein the pressure sensor is a first pressure sensor configured to detect a first pressure in the first selectively-pressurized fluid conduit on a first side of the coupling, the coupling fault detecting system further including:

a second pressure sensor configured to detect a second pressure in the second selectively-pressurized fluid conduit on a second side of the coupling opposite from the first side, and communicate a signal indicative of the second pressure to the controller; and the controller further configured to determine whether a pressure difference across the coupling based upon the first and second pressures is indicative of a potential fault.

3. The coupling fault detecting system of claim 2, wherein the controller is further configured to compare the pressure difference across the coupling with a threshold.

4. The coupling fault detecting system of claim 1, wherein the pressure sensor is further configured to include a signal indicative of a location of the coupling with the signal indicative of the pressure at the coupling.

5. The coupling fault detecting system of claim 2, wherein the controller is further configured to determine the pressure difference across the coupling as a function of time.

6. The coupling fault detecting system of claim 5, wherein the controller is further configured to compare the pressure difference across the coupling as a function of time with a threshold.

7. The coupling fault detecting system of claim 1, wherein the first selectively-pressurized fluid conduit is on a first consist vehicle and the second selectively-pressurized fluid conduit is on a second consist vehicle, the coupling fault detecting system further including:

a third selectively-pressurized fluid conduit on the first consist vehicle;

a fourth selectively-pressurized fluid conduit on the second consist vehicle;

the third and fourth selectively-pressurized fluid conduits forming part of a consist air brake system; and the pressure sensor further configured to detect a pressure differential between the first and third selectively-pressurized fluid conduits on the first consist vehicle or between the second and fourth selectively-pressurized fluid conduits on the second consist vehicle.

8. The coupling fault detecting system of claim 7, wherein the controller is further configured to determine whether the pressure differential is indicative of a potential fault.

9. The coupling fault detecting system of claim 7, wherein the controller is further configured to compare the pressure differential with a threshold.

10. The coupling fault detecting system of claim 7, wherein the controller is further configured to determine the pressure differential as a function of time.

11. The coupling fault detecting system of claim 10, wherein the controller is further configured to compare the pressure differential as a function of time with a threshold.

12. A method of detecting a fault in a group of vehicles, wherein the group of vehicles includes at least first and second selectively-pressurized fluid conduits containing first and second communication cables that are communicatively coupled when the first and second selectively-pressurized fluid conduits are connected together, the method comprising:

detecting a pressure within the selectively-pressurized fluid conduits when the conduits are connected together;

communicating a signal indicative of the pressure through at least one of the first and second communication cables;

receiving the signal at a controller for the group of vehicles; and determining from the signal whether there is a fault in the connection between the first and second selectively-pressurized fluid conduits.

13. The method of claim 12, further including:

detecting a first pressure in the first selectively-pressurized fluid conduit;

detecting a second pressure in the second selectively-pressurized fluid conduit;

communicating signals indicative of the first and second pressures to the controller; and determining whether a pressure difference between the first and second pressures is indicative of a potential fault in the connection between the fluid conduits.

14. The method of claim 13, further including comparing the pressure difference between the first and second pressures with a threshold.

15. The method of claim 12, further including communicating a signal indicative of a location at which the pressure is detected within the selectively-pressurized fluid conduits.

16. The method of claim 13, further including determining the pressure difference between the first and second pressures as a function of time.

17. The method of claim 16, further including comparing the pressure difference as function of time with a threshold.

18. The method of claim 12, wherein the group of vehicles further includes at least a third fluid conduit located on a same vehicle as one of the first and second selectively-pressurized fluid conduits, the third fluid conduit forming a portion of an air brake system for the group of vehicles, the method further including detecting a pressure differential between the third fluid conduit and the one of the first and second selectively-pressurized fluid conduits.

19. The method of claim 18, further including comparing the pressure differential as a function of time with a threshold.

20. A coupling fault detecting system for a communication conduit, comprising:

a first selectively-pressurized fluid conduit;

a first communication cable disposed within the first selectively-pressurized fluid conduit, and configured to transmit a communication signal;

a second selectively-pressurized fluid conduit;

a second communication cable disposed within the second selectively-pressurized fluid conduit, and configured to transmit a communication signal;

a first coupling, the first coupling having a first end and a second end, and being connected at the first end of the first coupling to the first selectively-pressurized fluid conduit;

a second coupling, the second coupling having a first end and a second end, and being connected at the first end of the second coupling to the second selectively-pressurized fluid conduit;

the first and second couplings being connectable to each other at their respective second ends, and being configured to transmit a communication signal from the first communication cable to the second communication cable when the first and second couplings are connected together;

a first pressure sensor configured to detect pressure at the first coupling, and configured to communicate a first signal indicative of the pressure at the first coupling to the first communication cable;

a second pressure sensor configured to detect pressure at the second coupling, and configured to communicate a second signal indicative of the pressure at the second coupling to the second communication cable; and a controller configured to receive the first and second signals and determine from the first and second signals whether there is a fault in the connection between the first and second couplings.

* * * * *